US006886925B2

(12) United States Patent
Chen et al.

(10) Patent No.: US 6,886,925 B2
(45) Date of Patent: May 3, 2005

(54) POROUS BACK-SHOOTING INKJET PRINT HEAD MODULE AND METHOD FOR MANUFACTURING THE SAME

(75) Inventors: Chia-Tai Chen, Tainan (TW); Shyh-Haur Su, Hsinchu (TW); Chi-Ming Huang, Taipei (TW); Jinn-Cherng Yang, Ilan (TW); Chun-Jung Chen, Yunlin (TW); Je-Ping Hu, Hsinchu (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 115 days.

(21) Appl. No.: 10/336,741

(22) Filed: Jan. 6, 2003

(65) Prior Publication Data

US 2004/0130603 A1 Jul. 8, 2004

(51) Int. Cl.[7] ..... B41J 2/05; B41J 2/17
(52) U.S. Cl. ..... 347/84; 347/63
(58) Field of Search ..... 347/54, 56, 61, 347/63, 85–87

(56) References Cited

U.S. PATENT DOCUMENTS

| | | | | | |
|---|---|---|---|---|---|
| 5,703,633 | A | * | 12/1997 | Gehrer et al. | 347/86 |
| 5,877,794 | A | * | 3/1999 | Takagi | 347/87 |
| 5,940,099 | A | | 8/1999 | Karlinski | 347/70 |
| 5,949,460 | A | * | 9/1999 | Ahn | 347/86 |
| 5,949,461 | A | * | 9/1999 | Jones et al. | 347/87 |
| 6,412,918 | B1 | * | 7/2002 | Chen et al. | 347/56 |
| 6,561,626 | B1 | * | 5/2003 | Min et al. | 347/47 |

* cited by examiner

*Primary Examiner*—Stephen D. Meier
*Assistant Examiner*—An H. Do
(74) *Attorney, Agent, or Firm*—Birch, Stewart, Kolasch & Birch, LLP

(57) ABSTRACT

A porous back-shooting inkjet print head module is disclosed. The ink permeates through the porous ink supply layer into an ink chamber in contact with the outside by an injection hole, and the porous ink supply layer prevents the ink from flowing back. Therefore, the ink chamber is sealed very well and more pressure could be generated. The invention can thus be used for inks with high viscosities. It does not need a precision alignment process as in the prior art. This does not only increase the efficiency and yield of production, but also reduces the cost.

6 Claims, 4 Drawing Sheets

POROUS BACK-SHOOTING INKJET PRINT HEAD MODULE AND METHOD FOR MANUFACTURING THE SAME

BACKGROUND OF THE INVENTION

1. Field of Invention

The invention relates to an inkjet print head module and the method for making the same. More particularly, it relates to a porous back-shooting inkjet print head module with a tightly sealed ink chamber and the method of manufacturing the same.

2. Related Art

The computer-related products have been widely used to all sorts of applications in various fields. In particular, the convenience of inkjet printers is most welcomed by the public. The print head of a conventional inkjet printer is a thermal inkjet print head. The working principle of this type of print heads is to supply a pulse voltage to a control chip. The voltage signal goes through a heater with high resistance and generates heat. The ink is heated into thermal bubbles. The ink droplets produced by such thermal bubbles are then ejected out of a nozzle onto paper or the surface of other objects. An ink channel is further provided to supply ink from an ink cartridge to an ink chamber.

FIG. 1 shows the structure of a conventional thermal bubble inkjet print head. A thermal barrier 202 is formed on a substrate 201. A resistor heating layer is formed on the thermal barrier 202. The thermal barrier 202 is used to prevent heat generated by the resistor heating layer 203 from entering the substrate 201. The resistor heating layer 203 is covered with a conductor layer 204 with low resistance, which is used to transmit voltage signals. An insulator layer 205 is formed on the conductor layer 204. An adhesion layer 206 is formed along the border of the insulator layer 205 and connects with a nozzle plate 209. The enclosed space is an ink chamber 207. One end of the ink chamber 207 has an ink channel for supplying ink from the ink cartridge to the ink chamber 207. When a pulse voltage signal is sent through the conductor layer 204 to the resistor heating layer 203, heat is generated to produce a thermal bubble 211 from the ink inside the ink chamber 207. The instantaneous pressure increase pushes the ink inside the ink chamber 207 toward and out of the nozzle 210, forming an ink droplet 212.

However, at the same time when the thermal bubble 211 is generated and ejects an ink droplet 212 out of the nozzle 210, the existence of the ink channel 208 often results in loss of the ejection pressure. Moreover, this type of inkjet print heads requires a precision sand blasting process to manufacture a hollow ink reservoir connecting the ink cartridge and the ink channel 208. The nozzle plate 209 and other relevant elements require precision alignment techniques to perform positioning and adhesion. This does not only time-consuming but also results in a low yield. The production cost, on the other hand, is higher. There are more and more high-viscosity inks on the market. The conventional print head structure is not suitable for such applications because of its sealing problem.

In the U.S. Pat. No. 5,940,099, Karlinski et. al. proposed an inkjet print head with ink supply through a porous medium. It mainly includes a piezoelectric material, a deflection layer, an ink supply layer, and a glass capillary. The working principle is to impose a voltage on the piezoelectric material to generate a deformation, ejecting the stored ink. However, the elements used in this method all require precision machining, alignment, and assembly technologies. Therefore, it has a higher cost and longer assembling time.

SUMMARY OF THE INVENTION

In view of the foregoing, the invention provides a porous back-shooting inkjet print head module and the corresponding manufacturing method. A porous ink supply plate is used to cover the nozzle, forming a chamber that is well sealed. As the ink is heated, a larger pressure can be provided to eject the ink from the ink chamber.

The disclosed porous back-shooting inkjet print head module of the invention includes a substrate, a thermal barrier, a heating layer, a conductor layer, an insulator layer, an electrode layer, an adhesion layer, and an ink supply layer. The substrate can be a silicon wafer, glass, metal, ceramics and polymers and have a nozzle. The thermal barrier is built above the substrate. The heating layer is made of a material with high resistance and is formed on the surface of the thermal barrier close to the nozzle. The thermal barrier is used to prevent heat generated by the heating layer from propagating to the substrate. The conductor layer is electrically connected to the heating layer and is covered by the insulator layer. The electrode layer is formed above the conductor layer and the insulator layer for receiving external pulse voltages and transmitting them to the conductor layer. When the pulse voltage flows through the conductor layer and reaches the heating layer, great heat is generated due to the high resistance of the heating layer. The adhesion layer is formed on the insulator layer and connected to the nozzle of the substrate. The ink supply layer is a porous material with one surface adhered to the adhesion layer and the other surface in contact with an ink cartridge. A well-sealed ink chamber is thus formed by the adhesion layer and the ink supply layer. The ink inside the ink cartridge flows to the ink chamber via the ink supply layer.

The disclosed method of making the porous back-shooting inkjet print head module has the following steps. First, provide a substrate, which can be a silicon wafer, glass, metal, ceramics, and polymers. One surface of the substrate is formed with a thermal barrier. The thermal barrier is further formed with a heating layer made of a material with high resistance. A conductor layer is formed on top of the heating layer. The conductor layer and the heating layer are electrically connected. An insulator layer is then formed on part of the surface of the conductor layer. A metal electrode layer is built on top of the insulator layer and the conductor layer to receive external pulse voltages. A through nozzle is formed on the substrate by sand blasting. Finally, part of the surface of the insulator layer is formed with an adhesion layer for the ink supply layer to adhere. A space connected with the nozzle is thus formed to be the ink chamber for storing ink from the ink supply layer. What is different from the prior art is that the invention does not require precision positioning of the nozzle and the relevant elements and nor does it need an ink channel. This does no only reduce the manufacturing cost, but further provide perfect sealing for the ink chamber. Therefore, it is ideal for ink with high viscosities.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 2:
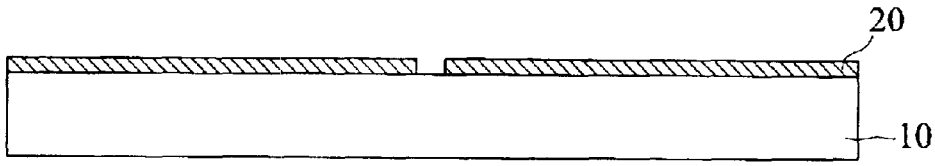
FIGS. 2 through 9 are schematic views of the flowchart of the first embodiment of the invention.
Figure 3:
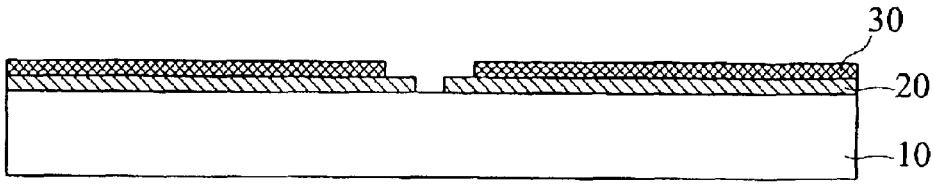
Figure 4:
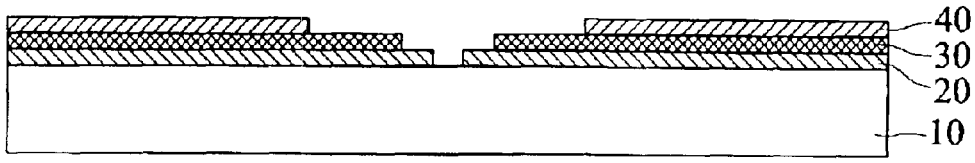
Figure 5:
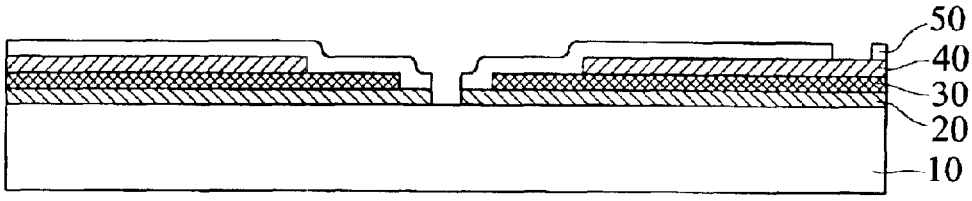
Figure 6:
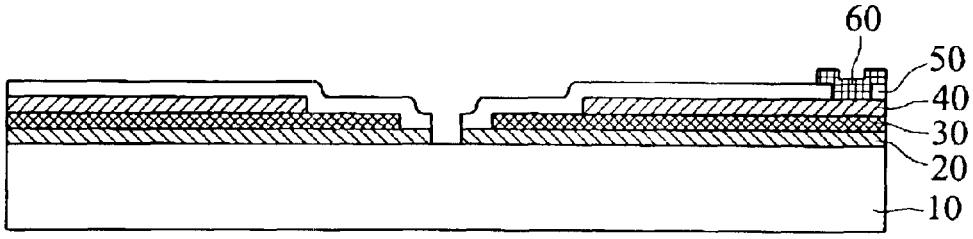
Figure 7:
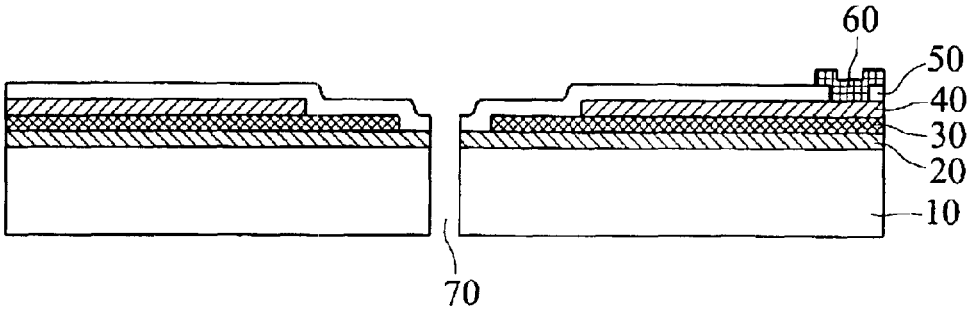
Figure 8:
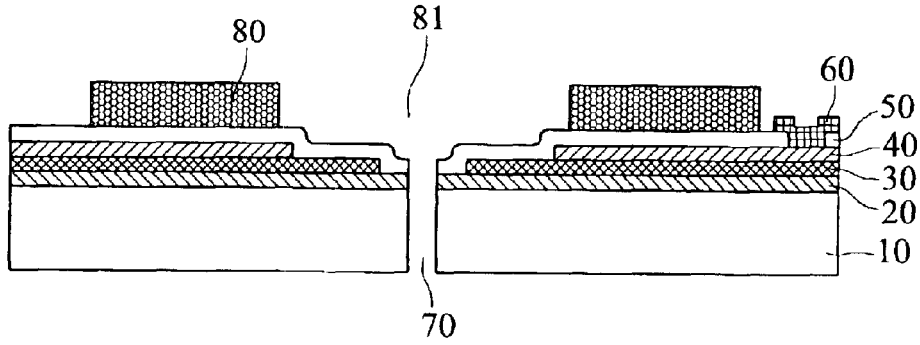
Figure 9:
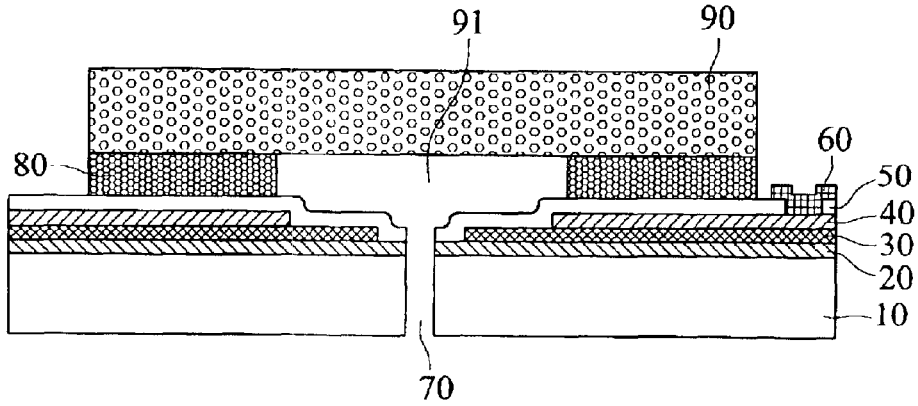

According to the invention, the porous back-shooting inkjet print head module receives an external pulse voltage, uses a well-sealed ink chamber and a porous ink supply layer to provide a large pushing force for the use of highly viscous ink. Please refer to FIGS. 2 to 9 for schematic view of the flowchart of the first embodiment of the invention. As shown in FIG. 2, a substrate 10 is provided. The substrate 10 can be made of a silicon wafer, glass, metal, ceramics, and polymers. The substrate 10 is formed with a thermal barrier 20. As shown in FIG. 3, a heating layer 30 is formed on the thermal barrier 30. A hole position on the thermal barrier 30 is saved for subsequent machining (to be described later). The heating layer 30 is made of a material with high resistance. As shown in FIG. 4, a discontinuous conductor layer 40 is formed on the heating layer 30. The heating layer 30 and the conductor layer 40 are in electrical communications. With reference to FIG. 5, an insulator layer 50 with a specific shape is formed on the conductor layer 40 using photolithographic and etching processes. As shown in FIG. 6, an electrode layer 60 is formed on the insulator layer 50 and the conductor layer 40 and is in electrical communications with the conductor layer 40. The electrode layer 60 is used to receive an external pulse voltage. With reference to FIG. 7, a through nozzle 70 is formed on the substrate 10 next to the heating layer 30 by sand blasting, laser, dry etching or wet chemical etching, so that the nozzle 70 is situated within the preserved hole position on the heating layer 30. As shown in FIG. 8, an adhesion layer 80 is formed on the part of the top surface of the insulator layer 50. An accommodation space 81 is formed by the annular structure of the adhesion layer 80. Finally, as shown in FIG. 9, a porous material is used to make an ink supply layer 90 covering the adhesive layer 80, forming an ink chamber 91 that is connected with the nozzle 70. That is, an ink chamber 91 containing the nozzle and the heating layer 30 is formed between the insulator layers 50.

Figure 10:
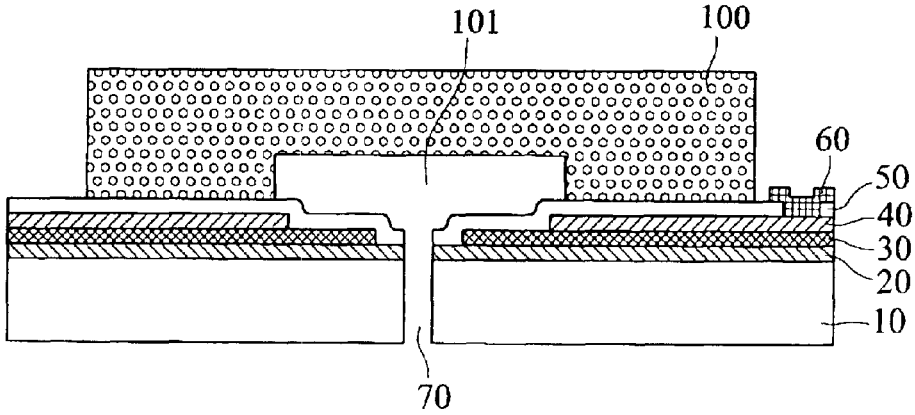
FIG. 10 is a schematic view of the second embodiment of the invention.

The adhesion layer 80 can be replaced by porous materials too. As shown in FIG. 10, a second embodiment of the invention uses a porous ink supply plate 100 replaces the adhesion layer 80. The bottom of the ink supply plate 100 is formed with an ink chamber 101 by electroforming. The ink chamber 101 is connected with a nozzle 70. Ink inside the ink cartridge (not shown) permeates through the ink supply plate 100 into the ink chamber 101. The ink supply plate 100 needs not to be totally made of a porous material. However, at least some part of it, preferably covering the nozzle 70 and the heating layer 30 has to be made of a porous material.

Figure 11:
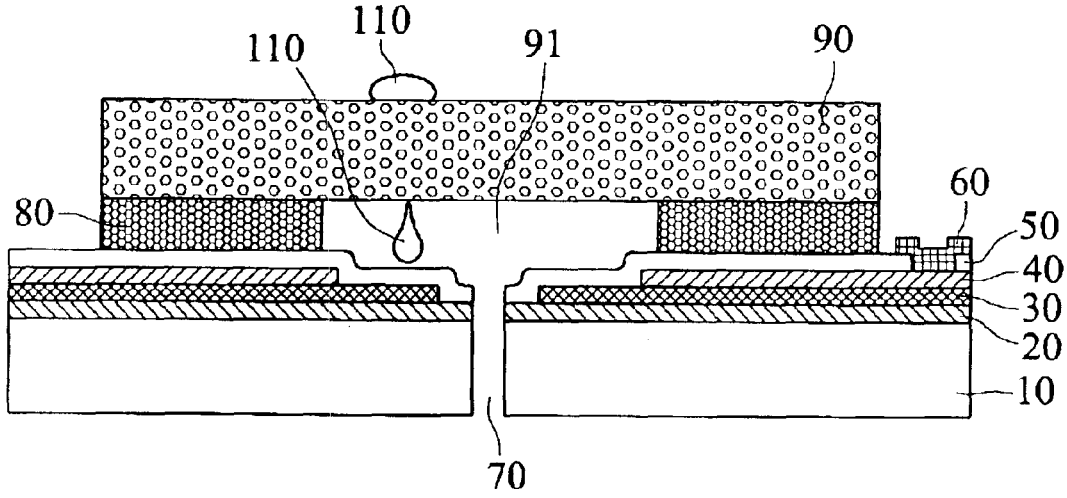
FIG. 11 is a schematic view of the first action according to the invention.

Please refer to FIG. 11, which outlines the first step of the invention. One side of the ink supply layer 90 is connected to the ink cartridge (not shown). Ink 110 inside the ink cartridge permeates through the ink supply layer 90 into the ink chamber 91. The insulator layer 50 is used to prevent ink 110 from being in contact with the conductor layer 40 to form a short circuit.

Figure 1:
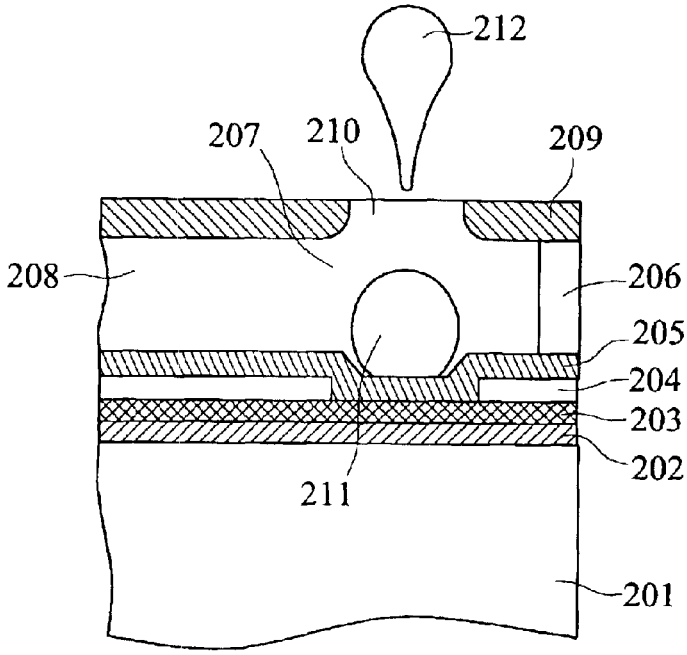
FIG. 1 (PRIOR ART)
FIG. 1 is a schematic cross-sectional view of a conventional thermal bubble inkjet print head.
Figure 12:
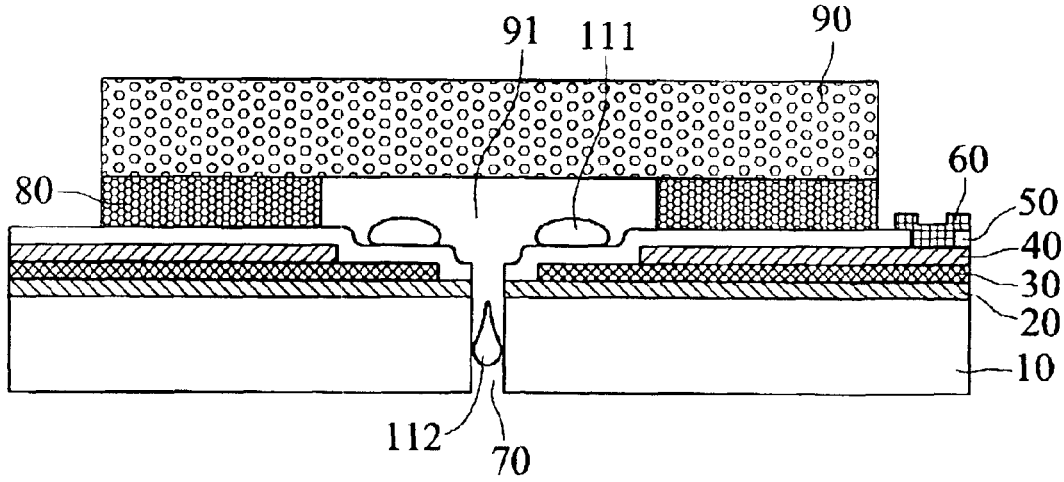
FIG. 12 is a schematic view of the second action according to the invention.

As shown in FIG. 12, the electrode layer 60 receives an external pulse voltage and transmits it to the conductor layer 40. Since the conductor layer 40 is formed on the heating layer 30 in a discontinuous way, the pulse voltage is transmitted from the heating layer 30 back to the conductor layer 40. When the pulse voltage passes through the heating layer 30, great heat is generated due to the high resistance of the heating layer 30. The ink stored inside the ink chamber 91 produces a thermal bubble 111. The instantaneous pressure increase in the ink chamber 91 pushes the ink droplet 112 out of the nozzle 70. Normally, the thermal bubble 211 generated by a conventional inkjet print head is parallel with the moving direction of the ink droplets 212, as shown in FIG. 1. This type of inkjet printing structure is called the top-shooting style. In the invention, the directions of the generated thermal bubble 111 and the droplet 112 are opposite. We call it the back-shooting style. According to the Darcy's law, the pressure differential is proportional to the speed of the fluid; i.e.

$$-\frac{\partial P}{\partial X} \propto V,$$

where P is the pressure, X is the flowing direction, and V is the velocity. However, the invention uses porous materials. The pressure differential is described by the corrected Darcy's law, where the pressure differential is a function of the first and third powers of the flowing speed:

$$-\frac{\partial P}{\partial X} = \frac{\mu}{K}V + \frac{\gamma\rho^2}{\mu}V^3,$$

where P is the pressure, X is the flowing direction, $\mu$ is the viscosity coefficient, $\rho$ is the fluid density, and V is the flowing speed. It is thus seen that the pressure difference generated by the invention is much greater than that produced using a conventional in channel. Besides, the disclosed structure does not need the conventional ink channel. Ink is directly supplied via a porous ink supply layer. The porous ink supply layer can also prevent ink from flowing back to the ink cartridge. Therefore, it provides a well-sealed ink chamber and a larger pressure difference. The invention can then be used for inks with high viscosities. Moreover, the nozzle is formed on the substrate using an etching process. No precision processes are involved. Consequently, the cost becomes lower.

EFFECTS OF THE INVENTION

The invention discloses a porous back-shooting print head module and the corresponding manufacturing method. A pulse voltage is sent to the conductor layer. The heating layer heats up the ink and generates thermal bubbles that eject ink droplets. Nozzles are directly formed on the substrate through an etching process. Therefore, neither nozzle plates nor precision alignment processes in the prior art are needed. Since the disclosed structure does not need an ink channel, the ink chamber is well sealed and provides a larger pressure difference. This solves the problem that most of the inkjet printers cannot support inks with high viscosities. Not only does the invention greatly reduce the manufacturing cost, it further promotes the quality and yield of the products.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A porous back-shooting inkjet print head module combined to an ink cartridge for receiving an external pulse voltage and ejecting ink from the ink cartridge, the porous back-shooting inkjet print head module comprising:

a substrate, which has at least one nozzle;

an ink supply plate, one side of which is connected to the ink cartridge, the other side has an accommodation space and covers the upper area of the nozzle of the substrate, forming a sealed ink chamber in connection with the nozzle, the ink supply plate above the ink chamber is made a porous material so that ink inside the ink cartridge permeates through the porous material into the ink chamber;

a heating layer, which is installed around the nozzle of the substrate inside the ink chamber;

a conductor layer, which is in electrical communications with the heating layer, receives and passes the pulse voltage to the heating layer for generating heat, the heat producing thermal bubbles in the ink chamber and the instantaneous pressure increase of which ejects ink out of the nozzle; and an insulator layer, which is installed above the conductor layer for preventing the ink from direct contact with the conductor layer, wherein the ink supply plate has an ink supply layer and an adhesion layer connected together, the adhesion layer having an annular structure to form the accommodation space.

2. The porous back-shooting inkjet print head module of claim 1, wherein the ink supply plate is made of a porous material and is formed with the accommodation space on its bottom in a unitary way.

3. The porous back-shooting inkjet print head module of claim 1, wherein a thermal barrier is inserted between the heating layer and the substrate for preventing the heat generated by the heating layer from dissipating to the substrate.

4. The porous back-shooting inkjet print head module of claim 1, wherein the heating layer is made of a material with high resistance.

5. The porous back-shooting inkjet print head module of claim 1, wherein the substrate is selected from the group consisting of a silicon wafer, glass, metals, ceramics and polymers.

6. The porous back-shooting inkjet print head module of claim 1, wherein the insulator layer and the conductor layer is further covered with an electrode layer for receiving the external pulse voltage and transmitting it to the conductor layer.

* * * * *